US006431604B1

(12) United States Patent
Goeckel

(10) Patent No.: US 6,431,604 B1
(45) Date of Patent: Aug. 13, 2002

(54) INLINE ROLLER SKATE WITH ATTACHED SLIDER PLATE

(76) Inventor: Gregory W. Goeckel, 1839 Sherwood Dr., Defiance, OH (US) 43512

( * ) Notice: Subject to any disclaimer, the term of this patent is extended or adjusted under 35 U.S.C. 154(b) by 0 days.

(21) Appl. No.: 09/492,963

(22) Filed: Jan. 28, 2000

Related U.S. Application Data

(60) Provisional application No. 60/118,015, filed on Jan. 29, 1999, and provisional application No. 60/134,635, filed on May 18, 1999.

(51) Int. Cl.[7] ..... A63C 17/00

(52) U.S. Cl. ..... 280/811; 280/11.223; 403/105

(58) Field of Search ..... 280/811, 11.223, 280/11.231, 11.27, 11.19, 87.042; 403/93, 84, 103

(56) References Cited

U.S. PATENT DOCUMENTS

| | | | | |
|---|---|---|---|---|
| 2,209,116 A | * | 7/1940 | Friedmann | 280/11.19 |
| 3,963,252 A | | 6/1976 | Carlson | |
| 4,125,273 A | | 11/1978 | Rothmayer | |
| 4,578,835 A | | 4/1986 | Pichler et al. | |
| 4,645,223 A | | 2/1987 | Grossman | |
| 4,711,458 A | | 12/1987 | Shim | |
| 5,046,746 A | * | 9/1991 | Gierveld | 280/11.2 |
| 5,048,848 A | | 9/1991 | Olsen et al. | |
| 5,505,470 A | | 4/1996 | Hoshizaki | |
| 5,551,711 A | * | 9/1996 | Mangelsdorf | 280/11.2 |
| 5,560,625 A | * | 10/1996 | Kuykendall | 280/11.2 |
| 5,591,509 A | | 1/1997 | Lorenz et al. | |
| 5,595,392 A | | 1/1997 | Casillas | |
| 5,649,717 A | | 7/1997 | Augustine et al. | |
| 5,695,209 A | | 12/1997 | Deborde et al. | |
| 5,741,017 A | * | 4/1998 | Chen | 280/11.2 |
| 5,772,220 A | * | 6/1998 | Gaster | 280/11.22 |
| 5,823,545 A | | 10/1998 | Goeckel | |
| 5,934,693 A | * | 8/1999 | Nicoletti | 280/11.2 |
| 5,967,552 A | * | 10/1999 | Roderick et al. | 280/11.22 |
| 6,029,983 A | * | 2/2000 | Wegener | 280/11.2 |

FOREIGN PATENT DOCUMENTS

| | | |
|---|---|---|
| GB | 29137 | 2/1911 |

* cited by examiner

*Primary Examiner*—Gregory A. Morse
*Assistant Examiner*—Elaine Gort
(74) *Attorney, Agent, or Firm*—Leydig, Voit & Mayer, Ltd.

(57) ABSTRACT

An inline roller skate frame assembly for attachment to a boot is provided which facilitates lateral sliding movement over a substrate. The frame assembly including a mounting flange adapted for attachment to the boot and a pair of laterally spaced parallel side rails depending from the mounting flange. The frame assembly has a plurality of wheels each of which is rotatably supported on a corresponding wheel axle. The opposing ends of each wheel axle are received in a respective one of the parallel side rails. At least one slider plate is carried on an external surface of one of the side rails. The slider plate has a beveled lower edge which defines a slide surface engageable with and slidable over a substrate with the wheels not contacting the substrate. The slider plate is arranged and configured to overlie at least a portion of the external surface of the side rail adjacent the toe and heel ends of the side rail.

23 Claims, 9 Drawing Sheets

FIG. 6
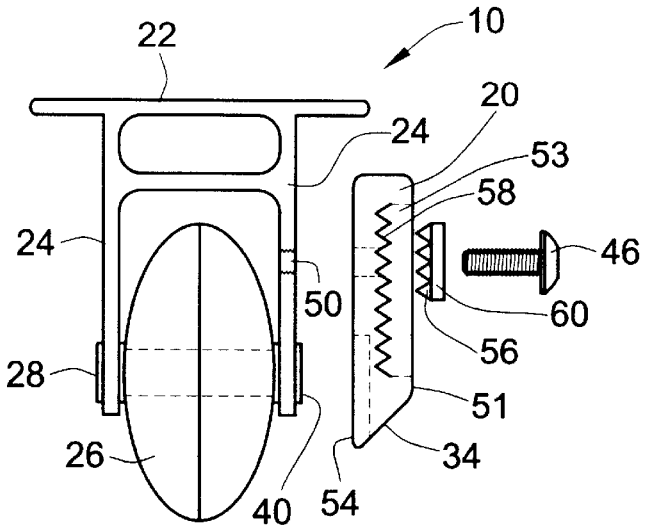
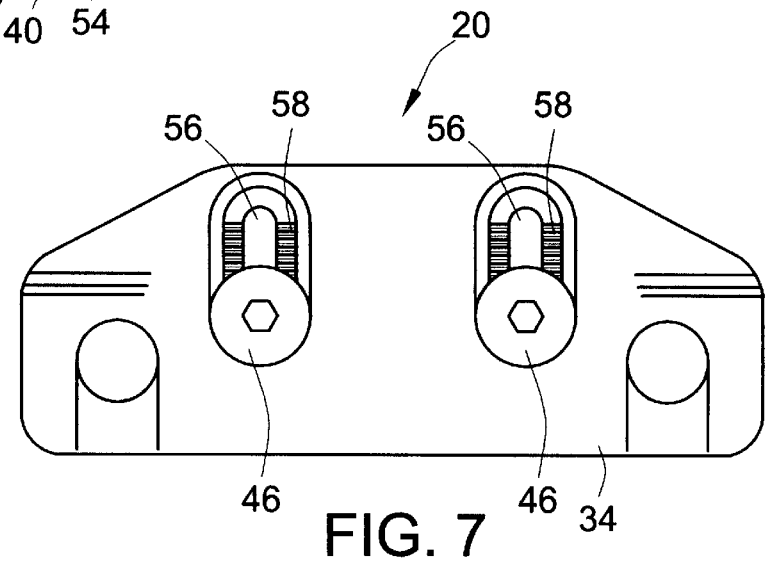
FIG. 7
FIG. 8
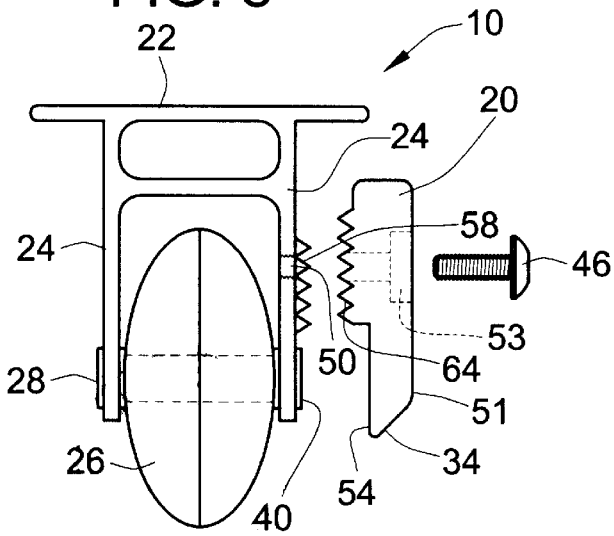

FIG. 12
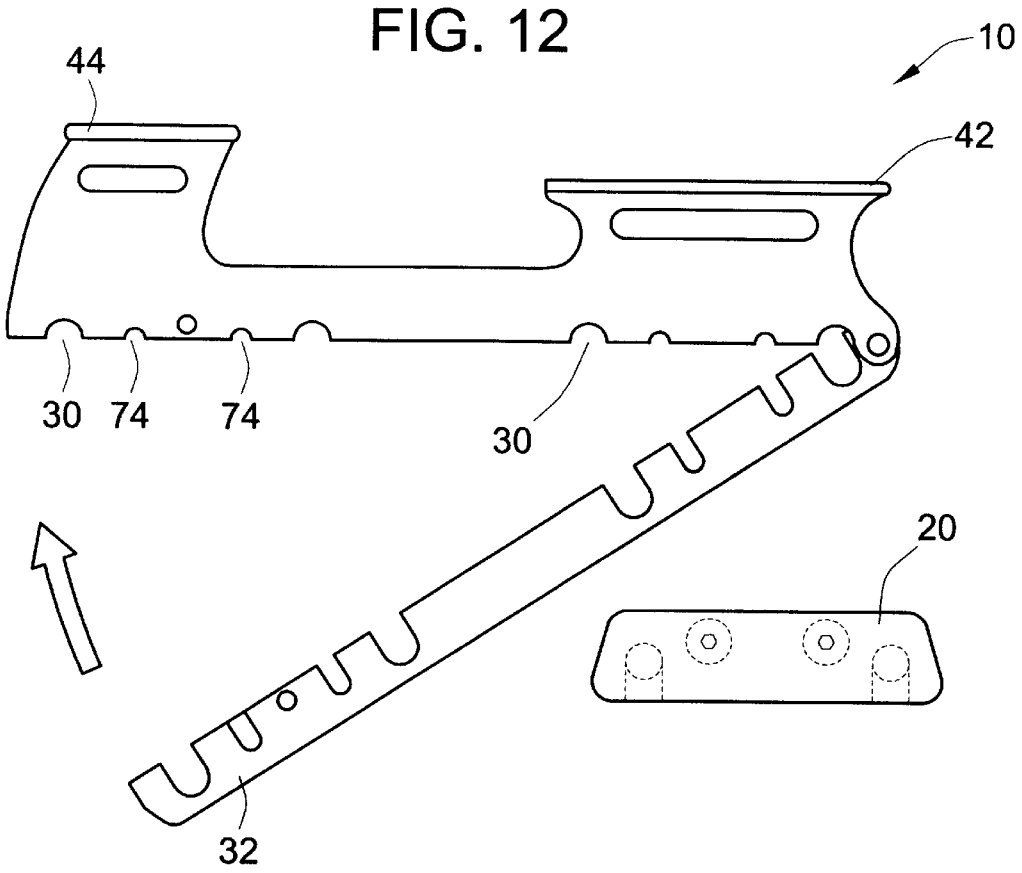
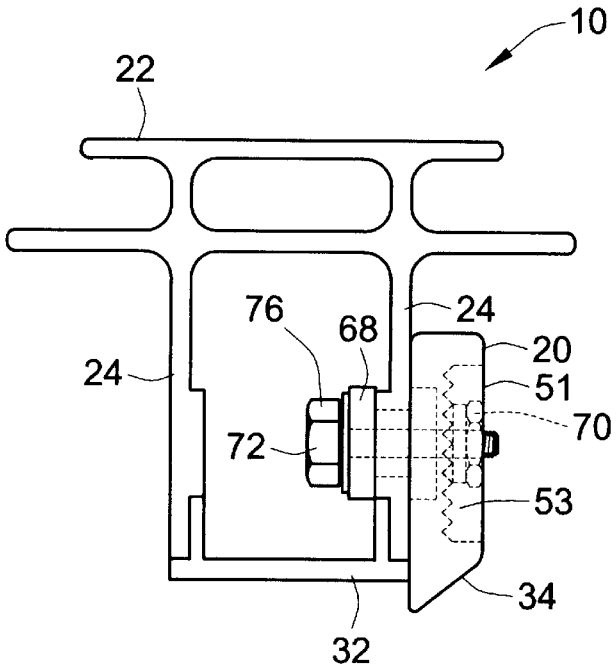
FIG. 13

INLINE ROLLER SKATE WITH ATTACHED SLIDER PLATE

CROSS-REFERENCE TO RELATED APPLICATIONS

This application claims the benefit of U.S. Provisional Application No. 60/118,015 filed Jan. 29, 1999 and U.S. Provisional Application No. 60/134,635 filed May 18, 1999 each of which is incorporated herein by reference.

FIELD OF THE INVENTION

The present invention relates to inline roller skates and, more particularly to an inline roller skate frame adapted to facilitate improved lateral sliding of the inline roller skate.

BACKGROUND OF THE INVENTION

The use of inline roller skates has become an extremely popular recreation activity. In general, inline roller skates include a plurality of wheels that are rotatably supported in a common plane by a frame which, in turn, is mounted to the underside of a boot. One of the most popular recreational activities involving inline roller skates is roller hockey. In fact, roller hockey has become so popular that it is now even played in professional leagues. Roller hockey is played in much the same manner as conventional ice hockey, however, as opposed to ice skates, all of the players are outfitted with inline roller skates.

One of the ways in which roller hockey can differ significantly from ice hockey is the play at the goaltender position. A hockey goaltender often must slide one or both skates laterally very quickly in order to get his body or pads in position to block a shot. As compared to ice skates, however, lateral sliding movement can be very difficult to accomplish with inline roller skates. In particular, when a goaltender using inline roller skates kicks out one or both of his legs in order to block a shot, the wheels, axle bolts, frame and boot of the inline skate can scrape along the skating surface, significantly slowing down the sliding movement. Since these components present an unevenly contoured surface, the sliding movement is also very uneven and awkward further hampering the goaltender's ability to block the shot. Additionally, the scraping action on these components of the inline skate also causes them to wear quickly, leading to a need for premature replacement of the components, or even, the entire skate.

Attachments are available for inline skates which facilitate so-called "aggressive" skating maneuvers like lateral sliding over round or curved objects such as a pole or street curb. This type of attachment is mounted in the middle of the side of the skate frame via the existing wheel axles and includes a rounded notch in its lower edge with which the user can engage a rounded or curved surface so as to allow the skate to slide laterally over that curved surface. Such attachments, however, are not well suited for use in a lateral sliding maneuver over a non-curved surface such as a typical skating surface because they only provide a sliding surface in the middle portion of the skate frame. Accordingly, when sliding over a substantially flat surface, the heel or toe area of the skate frame can dig into the ground, throwing the user off balance as well causing significant damage to the skate frame.

OBJECTS AND SUMMARY OF THE INVENTION

Accordingly, in view of the foregoing, a general object of the present invention is to provide an inline roller skate which allows quick and easy lateral sliding over a skating surface.

A related object of the present invention is to provide an inline roller skate frame specifically adapted for use in playing the goaltender position in roller hockey.

A further object of the present invention is to provide an inline roller skate frame which is resistant to wear caused by lateral sliding of the inline skate along a skating surface.

These and other features and advantages of the invention will be more readily apparent upon reading the following description of a preferred exemplary embodiment of the invention and upon reference to the accompanying drawings wherein:

BRIEF DESCRIPTION OF THE DRAWINGS

FIG. 6 is a partially exploded end view of the inline skate frame of FIG. 1 showing an alternative embodiment of the slider plate which includes an adjustable mounting arrangement.

FIG. 7 is a side elevation view of the slider plate of FIG. 6.

FIG. 8 is a partially exploded end view of an alternative inline skate frame configuration and an another embodiment of the slider plate which provide for adjustable mounting of the slide plate.

FIG. 12 is a partially exploded side elevation view of another alternative embodiment of the skate frame and slider plate according to the present invention which allows the slider plate to be mounted to the skate frame without the use of any tools.

FIG. 13 is an end elevation view of the skate frame and slider plate of FIG. 12 with an adjustable mounting arrangement.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
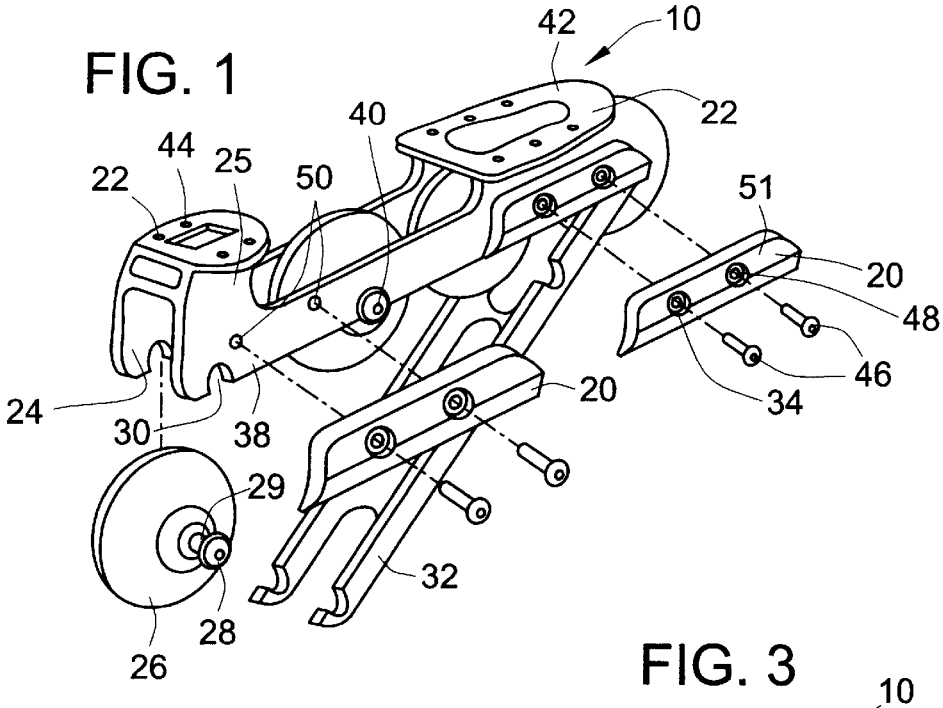
FIG. 1 is a partially exploded perspective view of an illustrative inline roller skate frame having, in this case, a pair of slider plates constructed in accordance with the teachings of the present invention.
Figure 3:
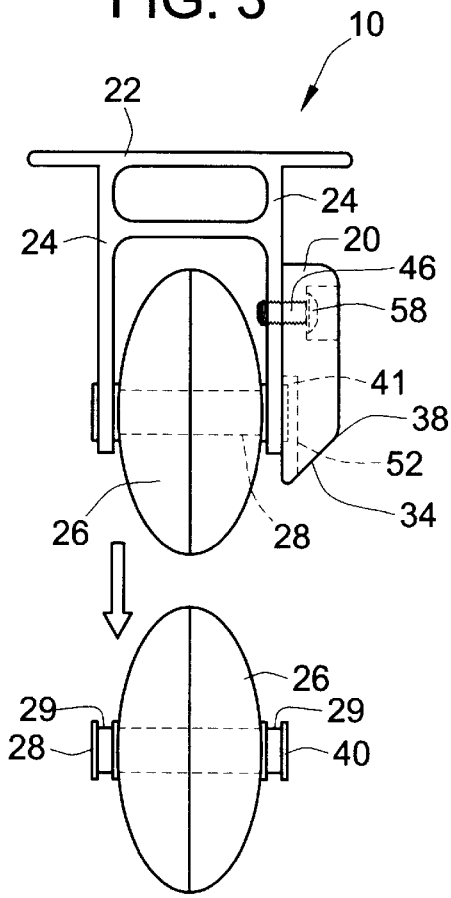
FIG. 3 is an end view of the inline skate frame of FIG. 1 illustrating how the inline wheels can be removed from the skate frame.
Figure 4:
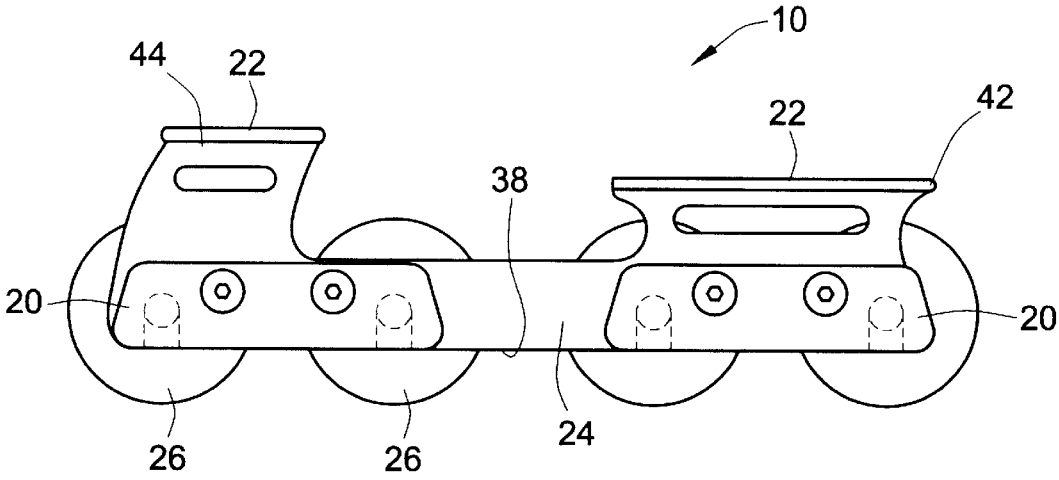
FIG. 4 is a side elevation view of the inline skate frame and slider plates of FIG. 1.

Referring now more particularly to FIG. 1, there is shown an illustrative inline roller skate frame 10 which includes a slider plate 20 constructed in accordance with the teachings of the present invention. The illustrated skate frame 12 includes, in this case, a pair of mounting flanges by which the skate frame is attached to a suitable boot 22. A pair of laterally spaced, parallel side rails 24 depend downwardly from the mounting flanges 22 so as to define a channel within which a plurality of wheels 26 are rotatably supported in a common plane. More specifically, as shown in FIGS. 1 and 3, each wheel 26 is rotatably supported via a bushing on a respective axle bolt 28, the opposing ends of which are received in a respective one of the parallel side rails 24. While the present invention is described in connection with certain wheel mounting arrangements, it will be readily appreciated that the present invention is equally applicable to other wheel mounting configurations. For example, as described in greater detail below, the present invention can be applied to both inline skate frames using a conventional mounting approach wherein the wheel axles are mounted to the frame rails through the use of tools, as well as, skate frames which are configured as disclosed in U.S. Pat. No. 5,823,545 so as to allow the wheels to be removed and replaced without the use of any tools.

In the embodiment of the invention shown in FIGS. 1 and 3, axle lugs 29 are provided on either end of the wheel axle bolt 28 which are received in complementarily shaped axle slots 30 in the lower edge of the side rail 24. To permit the wheels 26 to be mounted to and removed from the skate frame 10 without the use of auxiliary tools, the axle slots are open at their lower end and are closed off via a retention member 32. In this case, the retention member 32 is pivotally connected to the side rails 24 of the frame 10 so as to be movable between an open position wherein the wheels 26 can be slid out their respective axle slots 30 by hand and an closed position wherein the retention member 32 engages the axle lugs 29 and closes off the axle slots so as to lock the wheels in the frame. In the illustrated embodiment, the retention member 32 can be locked in the closed position via any suitable hand operable securing or locking mechanism. Additional details regarding this mounting arrangement for the wheels are disclosed in the aforementioned U.S. Pat. No. 5,823,545.

Figure 2:
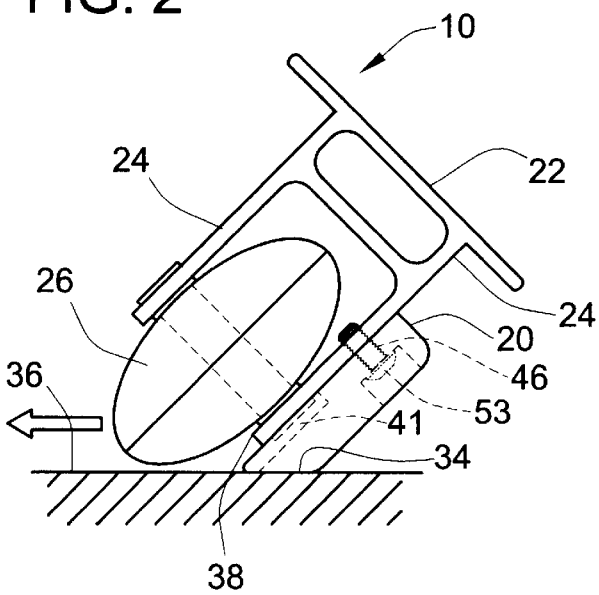
FIG. 2 is an end view of the illustrative inline skate frame of FIG. 1 showing the slider plates in contact with a skating surface so as to facilitate lateral sliding of the skate frame.

In accordance with one important aspect of the present invention, the inline skate frame 10 includes a slider plate 20 which facilitates lateral sliding movement of the inline skate along a skating surface, as well as protects the frame from wear associated with such lateral sliding. More specifically, the slider plate 20 covers the exposed components on the side of the skate frame 10 and presents a surface which will slide readily and consistently across the skating surface. To this end, as shown in FIGS. 1–5, the slider plate 20 is removably mountable to the exterior surface of one of the side rails 24 of the skate frame 10 and is provided with a beveled or angled lower edge 34. As shown in FIG. 2, when the slider plate 20 is mounted to the side rail 24, the angled lower edge 34 of the slider plate provides a surface along which the inline skate can slide laterally over a skating surface 36 without the wheels 26 contacting the ground.

By orienting the skate at an angle relative to the upright position, a user can bring the angled lower edge 34 of the slider plate 20 into contact with the skating surface 36 and lift the wheels 26 off of the skating surface. The user can then slide the skate along the skating surface with the skate, and in turn the user, being supported on the lower edge 34 of the slider plate 20. The angled lower edge 34 preferably has a substantially smooth surface such that it will slide in an easy and consistent manner. Similarly, the slider plate 20 is preferably constructed of a material which will offer relatively minimal friction when sliding over a skate surface, such as, for example, metal or plastic. Alternatively, the slider plate 20 could be configured such that just the lower edge 34 thereof is constructed, plated or coated with a material which will facilitate easy and consistent sliding easily and consistently. While the invention is described in connection with the lateral (i.e. side-to-side) sliding which is advantageous in the context of playing the goaltender position in roller hockey, it will be appreciated that the slider plate actually permits a user to slide the inline skate in any desired direction.

Figure 5:
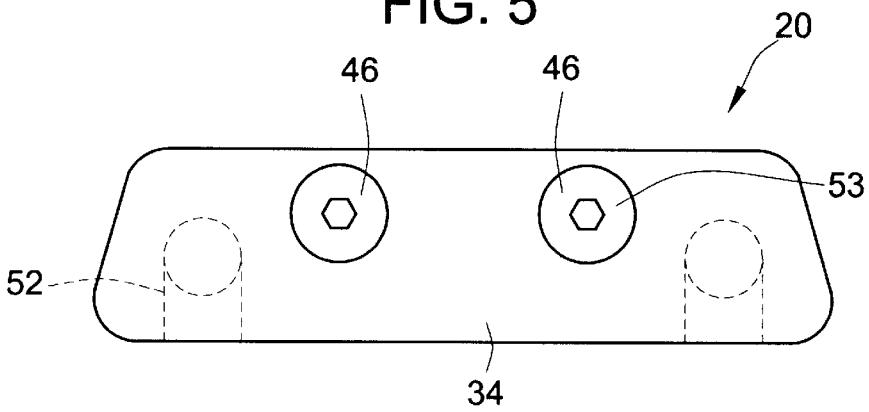
FIG. 5 is a side elevation view of one of the slider plates of FIG. 1.

To help protect the skate frame 10 from excessive wear and other damage caused by laterally sliding the inline skate, the slider plate 20 can be configured such that it covers the exposed components along the side of the skate frame which otherwise would scrape along the ground when a user laterally slides the inline skate. In particular, the slider plate 20 can be configured such that it protects the lower edge 38 of the side rails 24 of the frame as well as the exposed ends 40 of the wheel axle bolts 28. For example, in the embodiment shown in FIGS. 1 and 4, a pair of slider plates 20 are provided on the exterior surface of the side rail 24 with one being arranged toward each end of the skate frame 10. As shown in FIGS. 2 and 3, each of the slider plates 20 is arranged such that a portion of the slider plate extends beyond or overhangs the lower edge 38 of the side rail 24. Moreover, each of the slider plates 20 is configured such that it covers, in this case, two of the exposed axle bolt ends 40. To allow for placement of the slider plates 20 over the exposed axle bolt ends 40, corresponding recesses 41 are provided on the inner face 54 of slider plate as shown in FIGS. 3 and 5. Optionally, the two slider plates 20 can have the same shape and size to allow a user to switch positions (e.g., at the toe or heel end of the frame) of the slider plates as desired.

With this arrangement, when a user positions the inline skate to perform a lateral sliding maneuver neither the lower edge 38 of the side rail 24 nor any of the exposed ends 40 of the axle bolts 28 will contact the ground. In addition, providing slider plates 20 at both the toe and heel ends 42, 44 of the skate frame 10 helps a user balance the inline skate when performing the lateral sliding maneuver thereby making the sliding action much more stable. As will be appreciated, the slider plate 20 can comprise one single plate (see FIGS. 21 and 22) or multiple separate plates mounted on the side rail 24. However, to ensure that the toe or heel ends 42, 44 of the skate frame 10 do not dig into the ground when sliding, as well as to provide sufficient stability and balance for the user, the slider plate or plates 20 should cover at least the areas adjacent the toe and heel ends of the side rail 24. Likewise, the slider plates 20 can be attached to the exterior of one or both of the rails 24. However, if a slider plate is provided on only side of the skate frame, for use at the goaltender position, it is preferable that the sliding plate be provided on the side of the skate frame which faces inside when the skate is being worn by a user.

Figure 21:
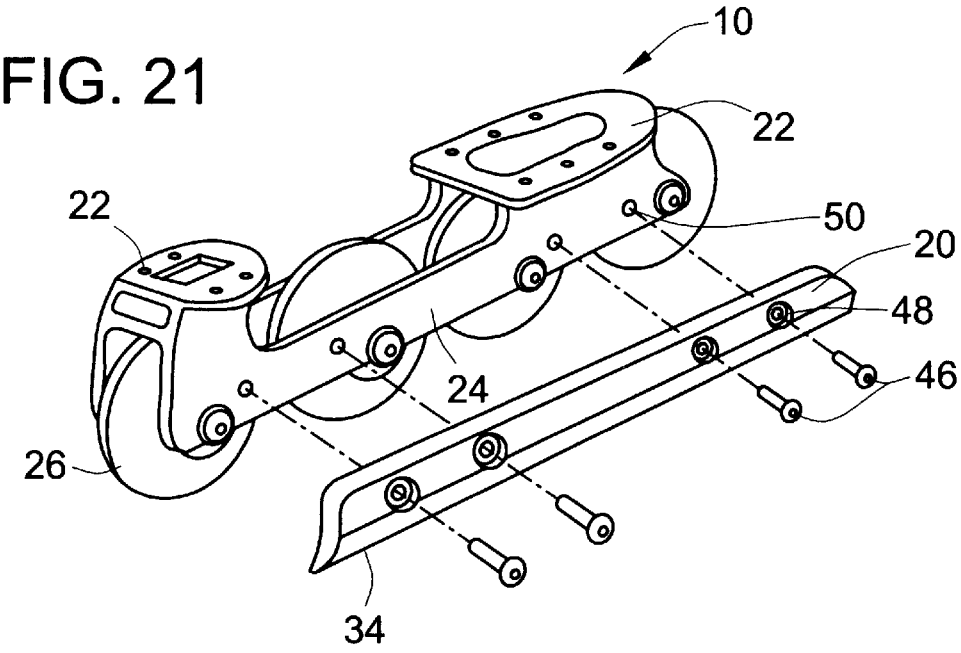
FIG. 21 is a partially exploded perspective view of the skate frame of FIG. 1 and an alternative embodiment of a slider plate.

As will be appreciated, the one or more slider plates 20 can be mounted on the skate frame 10 in any suitable manner. However, to allow the slider plate 20 to be attached to existing skate frames 10, in one embodiment of the invention, the slider plate can be configured so as to be mountable to the side rail 24 using conventional mounting hardware such as screws or bolts. For example, as shown in FIG. 1, the slider plate 20 can be secured to the side rail 24 by mounting bolts 46 which are inserted through mounting holes 48 provided in the slider plate and received in holes 50 that have been tapped in the side rail. To ensure that the mounting bolts 46 do not impair a user's lateral sliding capability, the mounting holes 48 in the slider plate 20 can be countersunk in a counterbore 53 so that the ends of the bolts do not protrude from the exposed or outer face 51 of the slider plate 20. Of course, the mounting holes 48 in the side rail 24 should be positioned and the mounting bolts 46 sized such that mounting the slider plate 20 on the rail does not interfere with rotation of the wheels 26. This mounting arrangement for the slider plate 20 can be used with both a frame configured for removal of the wheels without tools such as shown in FIG. 1 and a frame configured with conventionally supported wheel axles such as shown in FIG. 21.

Figure 22:
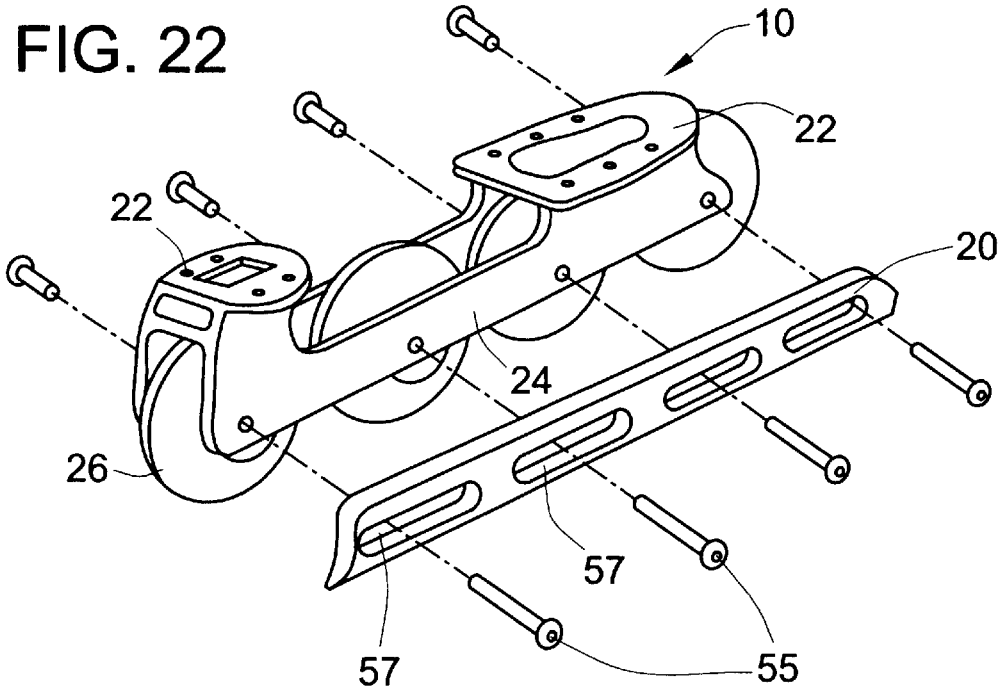
FIG. 22 is a partially exploded perspective view of another alternative embodiment of the skate frame and slider plate according to the present invention.

Alternatively, the slider plate 20 can be configured such that it can be attached to the side rail 24 of the skate frame through the use of conventional wheel axle bolts 55 as shown in FIG. 22. In this embodiment, the slider plate 20 is connected to the side rail 24 by inserting the axle bolts 55 through respective mounting holes 57 provided in the slider plate prior to securing the wheels to the frame. To ease mounting of the slider plate 20 to existing skate frames, the mounting holes 55 in the slider plate can be slotted to allow for variation in the position of the axle bolt mounting holes on the skate frame.

To facilitate removal and replacement of the inline skate wheels 26, the slider plate 20 can be configured so as to permit removal of the wheels while the slider plate 20 is still mounted on the skate frame 10. As shown in FIGS. 3 and 5, slots 52 can be provided on the inner face 54 of the slider plate 20 that extend downwardly from each of the recesses 41 which allow for placement of the slider plate over the ends of the axle bolts 28. In this case, each slider plate 20 includes two wheel recesses and slots 41, 52 which are positioned such that when the slider plate is mounted on the skate frame the recesses and slots overlie the exposed ends of the axle bolts 28. The slots 52 are open at their lower ends so as to allow the wheel to slide freely downward and out of the skate frame 10 when the retention member 32 is the open position.

Figure 9:
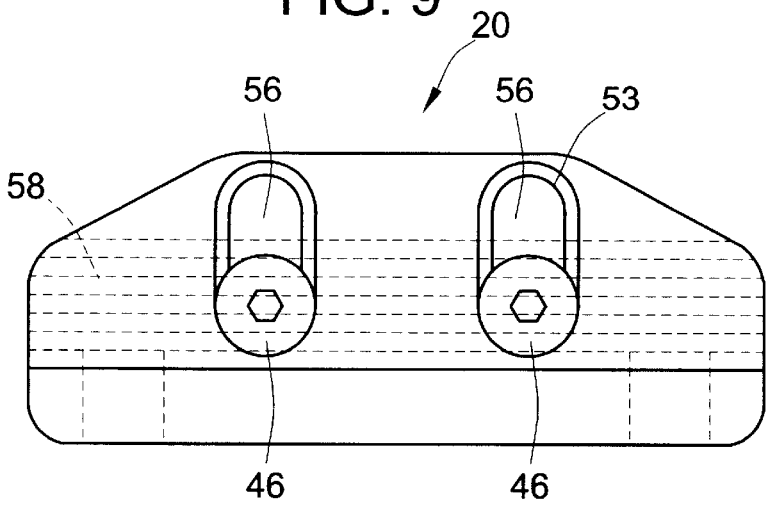
FIG. 9 is a side elevation view of the slider plate of FIG. 8.

According to a further aspect of the present invention, to compensate for wear of the slider plate 20 or to adjust the nature of the sliding action, the mounting arrangement for the slider plate can be configured so as allow the position of the slider plate 20 to be adjusted relative to the skate frame 10. More particularly, the mounting arrangement allows the slider plate 20 to be mounted in different vertical positions relative to the side rail 24 of the frame 10. The ability to adjust the vertical position of the slider plate 20 permits a user to keep a consistent bevel on the lower edge 38 of the slider plate as it wears from use. Moreover, such a mounting arrangement also allows a user to position the slider plate 20 relatively lower on the side rail 24 to effectuate a relatively quicker slide or to position the slider plate relatively higher on the slider plate in order to achieve a more angled and slower slide. As shown in FIGS. 6 and 7, this can be accomplished by providing a vertically extending slotted mounting hole 56 in the slider plate 20. Further, in the illustrated embodiment, ridged teeth 58 are provided in surrounding relation to the slotted mounting hole 56 in the counterbore 53 on the exposed face 51 of the slider plate. The ridged teeth 58 on the slider plate 20 engage with the complementarily shaped teeth of a ridged lock washer 60 in order to lock the slider plate into a desired mounting position. Thus, the slider plate 20 can be mounted in any position relative to the side rail 24, within the limits defined by the slotted mounting hole 56, simply by engaging the ridged lock washer 60 with the ridged teeth 58 surrounding the mounting hole in the desired position, and then securing the slider plate 20 with the mounting bolt 46. Alternatively, as shown in FIGS. 8 and 9, the ridged teeth 58 can be provided in surrounding relation to the slotted mounting hole 56 on the inner face of the slider plate. In this embodiment the need for a lock washer is eliminated as the ridge teeth 58 engage complementary teeth 64 provided on the exterior surface of the side rail 24 adjacent the mounting hole 48 therein. Those skilled in the art will appreciate that other adjustable mounting arrangements could also be used.

Figure 10:
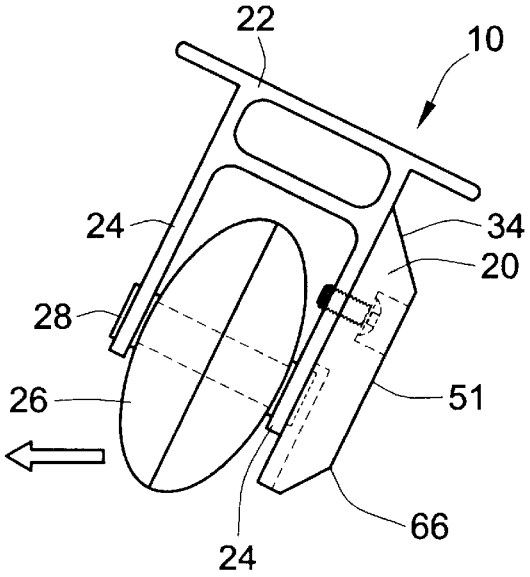
FIG. 10 is an end view of the inline skate frame of FIG. 1 and a further embodiment of the slider plate of the present invention.
Figure 11:
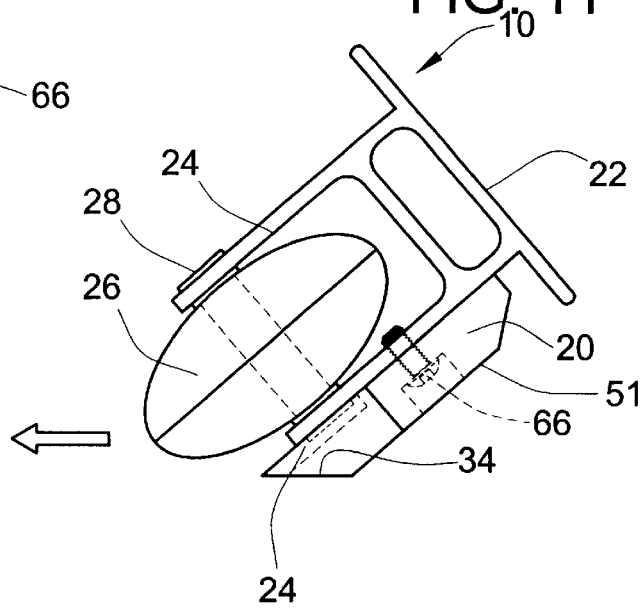
FIG. 11 is an end view of the inline skate frame and slider plate of FIG. 10 showing the slider plate mounted in reversed orientation.

Compensating for wear of the slider plate 20 and/or adjusting the nature of the sliding action can also be accomplished by providing a bevel on the upper edge 66 of the slider plate as well as on the lower edge 34, as shown in FIGS. 10 and 11. With this arrangement, the slider plate 20 becomes reversible enabling a user to turn the slider plate in order to switch the relative positions of the upper and lower edges 66, 34 of the slider plate when one of the edges becomes worn. Similarly, the upper edge 66 and lower edge 34 of the slider plate 20 can be configured so as to present differently angled slide surfaces such that reversing the orientation of the upper and lower edges can enable a user to vary the nature of the slide as desired. For example, as shown in FIG. 11, the angle of the lower edge 34 of the slider plate 20 defines a slide surface which produces a more angled and slower slide while the angle of the upper edge 66 defines a slide surface which permits a quicker sliding action. In the context of roller hockey, with the illustrated embodiment, a user wishing to play more of a "butterfly" style as a goaltender could use the lower edge 34 of the slider plate 20 as the slide surface while a user wishing to play more of "stand-up" style could use the upper edge 66 as the slide surface.

According to a further embodiment of the present invention, in order to allow for substantially quicker and more convenient mounting and removal of the slider plate 20, the slider plate can be configured such that it can be mounted to the skate frame 10 by hand, without the use of any auxiliary tools. As will be appreciated, mounting the slider plate 20 to the skate 10 frame using conventional hardware such as bolts or screws that require the use of tools can be fairly time consuming. In the context of roller hockey, this can discourage a user from switching between the goaltender position and a forward position during the course of a game. To allow for mounting and removal of the slider plate 20 without tools, the slider plate can be configured to be attached to the skate frame 10 using the same retention member 32 that allows the wheel axles 28 to be secured in their respective axle slots 30 in the side rails 24 of the frame without tools. In particular, in the embodiment shown in FIGS. 12–14, each slider plate 20 carries two mounting lugs 68 each of which is secured to the inside face 54 of the slider plate by the combination of a nut 70 and a bolt 72 which can be pre-tightened in place prior to mounting the slider plate. The mounting lugs 68 are configured to be received in complementarily shaped mounting slots 74 provided in the lower edge 38 of the side rail 24. To this end, the mounting slots 74 have an open lower end to permit the manual insertion (and removal) of the mounting lugs 68 into the slots when the retention member 32 is in the open position. The mounting lugs 68 are then secured in the mounting slots 74 by closing and locking the retention member 32.

Figure 14:
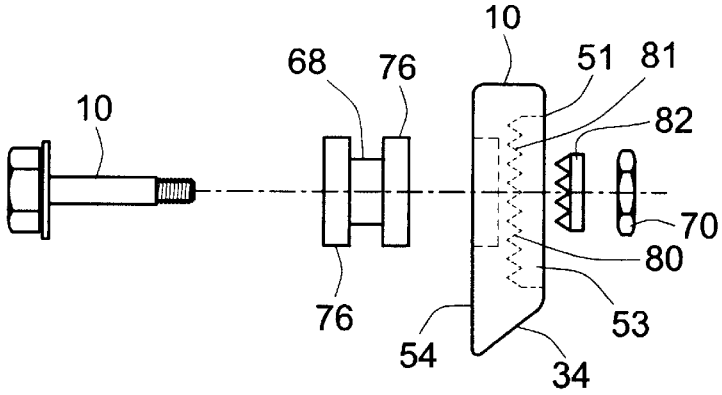
FIG. 14 is an exploded end view of the slider plate of FIG. 13.
Figure 15:
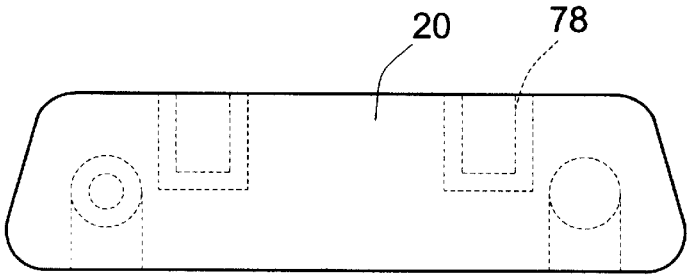
FIG. 15 is a side elevation view of a further embodiment of the slider plate for potential use with the skate frame of FIG. 12.
Figure 16:
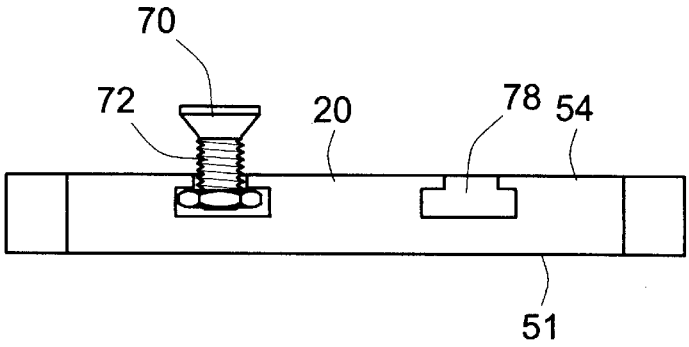
FIG. 16 is top view of the slider plate of FIG. 15.

To prevent movement of the mounting lugs 68 in the axial direction relative to the bolts 72, the mounting lugs include flanges 76 that engage the area around the edge of the mounting slot 74 on either side of the side rail 24. In addition, as with the embodiments shown in FIGS. 6 and 7, to ensure that the mounting hardware does not protrude from the exposed, outer face 51 of the slider plate 20, the area around the mounting hole 48 in the plate on the outer face is countersunk in the counterbore 53 as shown in FIG. 14. As opposed to using mounting holes which extend completely through the slider plate 20, in another alternative arrangement, the slider plate 20 could include vertically extending slots 78 on its inside facing side within which the heads of the slider plate mounting bolts 72 could be received and restrained against axial movement as shown in FIGS. 15 and 16. The slider plate 20 could then be attached to the skate frame 10 by tightening down the nut on a lug provided on the shaft of the bolt in a similar manner to the arrangement shown in FIG. 14.

As with the embodiments of the invention shown in FIGS. 6–8, the vertical position in which the slider plate 20 is mounted relative to the side rail 24 can be adjusted through the use of a slotted mounting hole 80 which is bounded by ridged teeth 81. As shown in FIG. 14, a complementarily ridged lock washer 82 can engage the ridged teeth 81 around the mounting hole 80 and secure the mounting bolt 72, and in turn the mounting lug 68, in the desired position relative to the slider plate 20.

Figure 17:
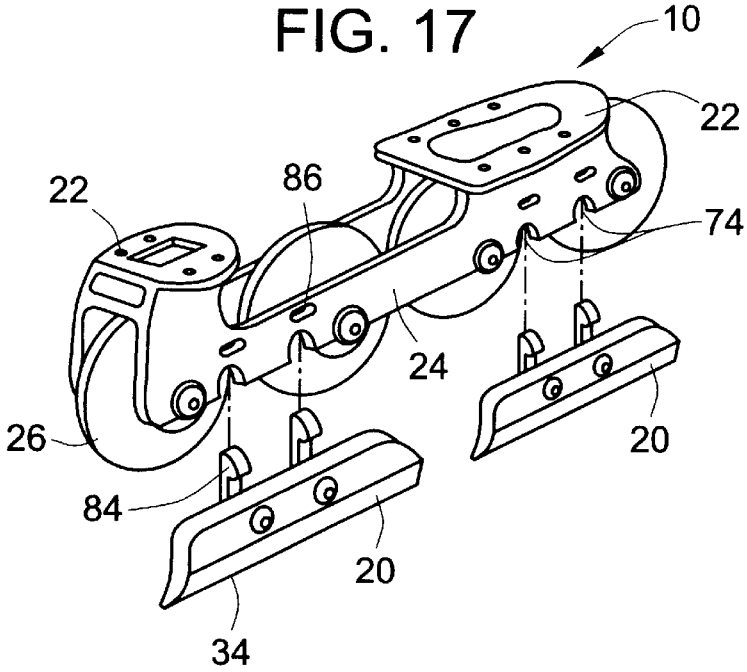
FIG. 17 is a partially exploded perspective view of another embodiment of the skate frame and slider plate constructed in accordance with the present invention which permits mounting of the slider plate without the use of any tools.
Figure 18:
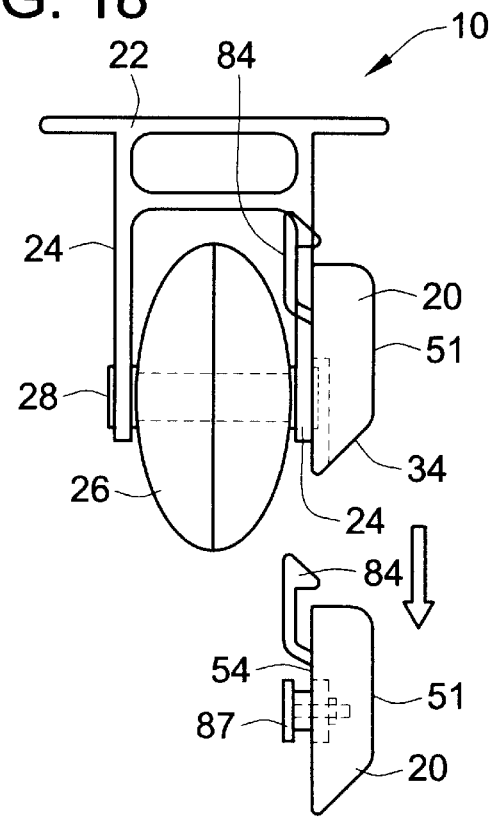
FIG. 18 is an end view of the skate frame and slider plate of FIG. 17 showing how the slider plate can be removed from the skate frame.
Figure 19:
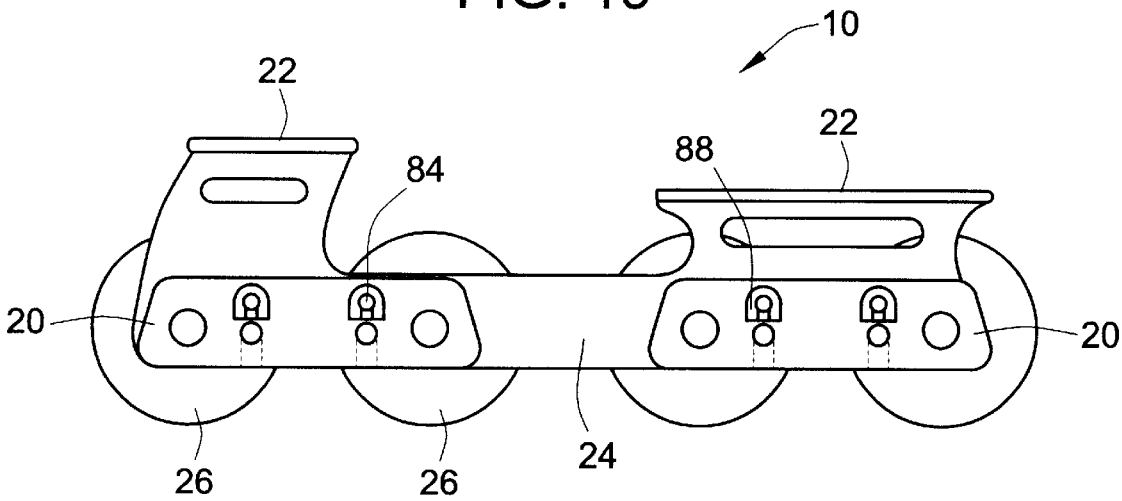
FIG. 19 is a side elevation view of yet another embodiment of the-skate frame and slider plate according to the present invention with which the slider plate can be mounted without the use of any tools.
Figure 20:
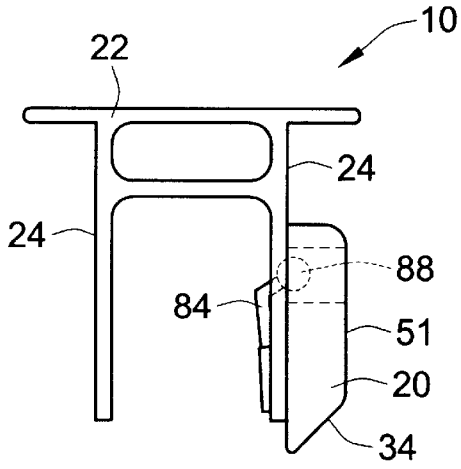
FIG. 20 is an end view of the skate frame and slider plate of FIG. 19.

Alternatively, other mounting arrangements could be utilized which would allow the slider plate 20 to be mounted to the side rail 24 of the frame 10 without tools. For instance, with the embodiment of the invention shown in FIGS. 17–18, the slider plate 20 is equipped with locking tabs 84 that extend away from the slider plate and are receivable into corresponding lock apertures 86 extending through the side rail 24 of the frame 10. The slider plate 20 is mounted to the frame by inserting mounting lugs 87 provided on the inside face of the slider plate 20 into the corresponding mounting slots 74 in the side rail 24 and then secured in position by engaging the locking tabs 84 with the lock apertures 86. The slider plate 20 can then be released simply by pushing, in this case, inwardly on the locking tabs 84. As shown in FIGS. 19 and 20, relatively shorter locking tabs 84 could be used if an opening 88 is provided in the slider plate 20 to allow for the spring action movement of the tab into engagement with the lock apertures 86 and to allow a user to push on the tab to manually release the slider plate.

From the foregoing, it will be appreciated that the slider plate of the present invention permits an inline skate user to execute a smooth, consistent and well-balanced lateral sliding maneuver. As such, the slider plate is particularly suited for adapting a inline skate frame for use in playing the goaltender position in roller hockey. Moreover, according to further aspects of the present invention, the slider plate can be configured such that it can be mounted to the skate frame without the use of any tool. Additionally, the slider plate can be configured to permit the position of the slider plate to be adjusted relative to the skate frame so as to compensate for wear or to provide a different type of sliding action.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. An inline roller skate frame assembly for attachment to a boot and for facilitating sliding maneuvers, the assembly comprising:

a mounting flange adapted for attachment to the boot, a pair of laterally spaced parallel side rails depending from the mounting flange, the side rails extending from a toe end to a heel end, each side rail having a substantially planar external surface, a plurality of wheels each of which is rotatably supported on a corresponding wheel axle, the opposing ends of each wheel axle being received in a respective one of the parallel side rails, and one or more slider plates carried on the substantially planar external surface of one of the side rails, each of the one or more slider plates having a beveled lower edge which defines a slide surface engageable with and slidable over a substrate with the wheels not contacting the substrate, the one or more slider plates being arranged and configured to overlie at least a portion of the external surface of the side rail adjacent the toe and heel ends of the side rail;

wherein a portion of each wheel axle extends through the side rail and the one or more slider plates are configured to overlie the portion of the each wheel axle that extends through the side rail.

2. The assembly of claim 1 wherein the assembly includes a single slider plate configured to extend substantially the entire length of the side rail.

3. The assembly of claim 1 wherein the assembly includes a plurality of slider plates one of which is mounted adjacent the toe end of the side rail and one of which is mounted adjacent the heel end of the side rail.

4. The assembly of claim 1 wherein each of the one or more slider plates is mounted to the side rail by at least one mounting bolt which extends through a mounting hole in the slider plate and is received in a mounting opening, in the side rail.

5. The assembly of claim 1 wherein each of the one or more slider plates extends in overhanging relation beyond a lower edge of the side rail.

6. The assembly of claim 1 further including a mounting mechanism for selectively mounting the one or more slider plates to the side rail with each of the one or more slider plates in different positions relative to a lower edge of the side rail.

7. The assembly of claim 6 wherein the mounting mechanism comprises a mounting bolt which extends through a slotted mounting aperture in each of the one or more slider plates and is received in a mounting hole in each of the one or more slider plates, the mounting bolt being retained in a desired position relative to the slotted mounting aperture by engagement of a ridged lock washer with corresponding ridges arranged adjacent the mounting slot.

8. The assembly of claim 6 wherein the mounting mechanism comprises a mounting bolt which extends through a slotted mounting aperture in each of the one or more slider plates and is received in a mounting hole in each of the one or more slider plates, the mounting bolt being retained in a desired position relative to the slotted mounting aperture by engagement of ridged teeth arranged on an inside face of each of the one or more slider plates with corresponding ridges arranged on the exterior surface of the side rail.

9. The assembly of claim 1 wherein the opposing ends of each wheel axle are received in respective pairs of opposing wheel slots in a lower edge of the side rail and each of the one or more slider plates includes a slotted recess on an inside face thereof, the slotted recess being configured so as to permit the wheel axles to be removed from their respective wheel slots when the one or more slider plates are on the side rail.

10. The assembly of claim 1 wherein each of the one or more slider plates has a second beveled edge and each of the one or more slider plates is selectively mountable on the side rail in a first orientation wherein the beveled lower edge is engageable with the substrate and in a second orientation wherein the second beveled edge is engageable with the substrate.

11. A slider plate assembly for attachment to an inline skate frame and for facilitating sliding maneuvers, the inline skate frame including a mounting flange adapted for attachment to the boot, a pair of laterally spaced parallel side rails depending from the mounting flange, the side rails extending from a toe end to a heel end, each side rail having a substantially planar external surface, and a plurality of wheels each of which is rotatably supported on a corresponding wheel axle, the opposing ends of each wheel axle being received in a respective one of the parallel side rails, the slider plate assembly comprising one or more slider plate members each of which is mountable to the substantially planar external surface of one of the side rails and each of which has a beveled lower edge which defines a slide surface engageable with and slidable over a substrate with the wheels not contacting the substrate, the one or more slider plate members being configured so as to be mountable to the side rail in overlying relation to at least a portion of the external surface of the side rail adjacent the toe and heel ends of the side rail, wherein each of the one or more slider plate members has a second beveled edge and each of the one or more slider plates is mountable to the side rail in a first orientation wherein the beveled lower edge is engageable with the substrate and in a second orientation wherein the second beveled edge is engageable with the substrate.

12. The assembly of claim 11 wherein the slider plate assembly includes one slider plate member configured to extend substantially the entire length of the side rail.

13. The assembly of claim 11 wherein the slider plate assembly includes a plurality of slider plate members one of which is mountable adjacent the toe end of the side rail and another of which is mountable adjacent the heel end of the side rail.

14. The assembly of claim 11 further including at least one mounting bolt which extends through a mounting hole in each of the one or more slider plate members and is receivable in a mounting opening in the side rail.

15. The assembly of claim 11 further including a mounting mechanism for selectively mounting the one or more slider plate members to the side rail in different positions relative to the side rail.

16. The assembly of claim 15 wherein the mounting mechanism includes a mounting bolt which extends through a slotted mounting aperture in each of the one or more slider plate members, the mounting bolt being retained in a desired position relative to the slotted mounting aperture by engagement of a ridged lock washer with corresponding ridges arranged adjacent the mounting slot.

17. The assembly of claim 15 wherein the mounting mechanism includes a mounting bolt which extends through a slotted mounting aperture in each of the one or more slider plate members, the mounting bolt being retained in a desired position relative to the slotted mounting aperture by ridged teeth arranged on an inside face of the slider plate member which arc engageable with corresponding ridges arranged on the exterior surface of the side rail.

18. An inline roller skate frame assembly for attachment to a boot and for facilitating sliding maneuvers, the assembly comprising:

a mounting flange adapted for attachment to the boot, a pair of laterally spaced parallel side rails depending from the mounting flange, the side rails extending from a toe end to a heel end, each side rail having a substantially planar external surface, a plurality of wheels each of which is rotatably supported on a corresponding wheel axle, the opposing ends of each wheel axle being received in a respective one of the parallel side rails, and one or more slider plates carried on the substantially planar external surface of one of the side rails, each of the one or more slider plates having a beveled lower edge which defines a slide surface engageable with and slidable over a substrate with the wheels not contacting the substrate, the one or more slider plates being arranged and configured to overlie at least a portion of the external surface of the side rail adjacent the toe and heel ends of the side rail;

wherein each of the one or more slider plates has a second beveled edge and each of the one or more slider plates is selectively mountable on the side rail in a first orientation wherein the beveled lower edge is engageable with the substrate and in a second orientation wherein the second beveled edge is engageable with the substrate.

19. The assembly of claim 18 wherein the assembly includes a single plate configured to extend substantially the entire length of the side rail.

20. The assembly of claim 18 wherein the assembly includes a plurality of plates one of which is mounted adjacent the toe end of the side rail and one of which is mounted adjacent the heel end of the side rail.

21. An inline roller skate frame assembly for attachment to a boot and for facilitating sliding maneuvers, the assembly comprising:

a mounting flange adapted for attachment to the boot, a pair of laterally spaced parallel side rails depending from the mounting flange, the side rails extending from a toe end to a heel end, each side rail having a substantially planar external surface, a plurality of wheels each of which is rotatably supported on a corresponding wheel axle, the opposing ends of each wheel axle being received in a respective one of the parallel side rails, and one or more slider plates carried on the substantially planar external surface of one of the side rails, each of the one or more slider plates having a beveled lower edge which defines a slide surface engageable with and slidable over a substrate with the wheels not contacting the substrate, the one or more slider plates being arranged and configured to overlie at least a portion of the external surface of the side rail adjacent the toe and heel ends of the side rail;

wherein the opposing ends of each wheel axle are received in respective pairs of opposing wheel slots in a lower edge of the side rail and each of the one or more slider plates includes a slotted recess on an inside face thereof, the slotted recess being configured so as to permit the wheel axles to be removed from their respective wheel slots when the one or more slider plates are on the side rail.

22. The assembly of claim 21 wherein the assembly includes a single plate configured to extend substantially the entire length of the side rail.

23. The assembly of claim 21 wherein the assembly includes a plurality of plates one of which is mounted adjacent the toe end of the side rail and one of which is mounted adjacent the heel end of the side rail.

* * * * *